US009990820B2

(12) United States Patent
Goppion

(10) Patent No.: US 9,990,820 B2
(45) Date of Patent: Jun. 5, 2018

(54) MUSEUM SHOWCASE, HAVING DETECTION SENSORS, ADJUSTMENT ACTUATORS, ALARMS AND A PROCESSING UNIT CONNECTED TOGETHER

(71) Applicant: GOPPION S.P.A., Trezzano Sul Naviglio (IT)

(72) Inventor: Alessandro Goppion, Milan (IT)

(73) Assignee: GOPPION S.P.A., Trezzano Sul Naviglio (MI) (IT)

( * ) Notice: Subject to any disclaimer, the term of this patent is extended or adjusted under 35 U.S.C. 154(b) by 0 days. days.

(21) Appl. No.: 15/299,381

(22) Filed: Oct. 20, 2016

(65) Prior Publication Data

US 2017/0236392 A1 Aug. 17, 2017

(30) Foreign Application Priority Data

Feb. 15, 2016 (IT) ..... UB2016A0768

(51) Int. Cl.
*G08B 13/14* (2006.01)

(52) U.S. Cl.
CPC ..... *G08B 13/14* (2013.01)

(58) Field of Classification Search
None
See application file for complete search history.

(56) References Cited

U.S. PATENT DOCUMENTS

2006/0032862 A1* 2/2006 Miller ..... B67D 1/0871 222/64

2014/0266668 A1* 9/2014 Blankenship ..... G08B 13/1436 340/501

(Continued)

FOREIGN PATENT DOCUMENTS

CN 201053737 Y 4/2008
CN 104586146 A 5/2015

(Continued)

OTHER PUBLICATIONS

Italian Search Report and Written Opinion for Italian Patent Application No. ITUB20160768 filed Feb. 15, 2016 on behalf of Goppion S.P.A. Report Completion Date: Oct. 4, 2016. 7 pages. Italian original + English translation.

*Primary Examiner* — Julie Lieu
(74) *Attorney, Agent, or Firm* — Steinfl + Bruno LLP

(57) ABSTRACT

This museum showcase comprises a display space visible to the public for receiving objects, at least a detection sensor of a parameter of the showcase and at least one of an alarm and an actuator for adjusting a parameter of the showcase. The museum showcase further comprises a processing unit and a showcase interface; the showcase interface is operatively connected between the sensor, the adjusting actuator and/or the alarm and the processing unit, in order to transmit information from the sensor to the processing unit and to transmit commands from the processing unit to the adjusting actuator and/or the alarm. The museum showcase is therefore completely controllable by means of the processing unit, which receives information from one or more dedicated sensors that is considered necessary for the specific showcase and which manages actuators and alarms so as to maintain the desired conditions and/or signal abnormal situations, according to the information received.

13 Claims, 2 Drawing Sheets

(56) References Cited

U.S. PATENT DOCUMENTS

| | | | | |
|---|---|---|---|---|
| 2015/0170608 | A1* | 6/2015 | Kim | G09G 5/14 345/592 |
| 2016/0055729 | A1* | 2/2016 | Maddox | G08B 13/1895 340/572.1 |

FOREIGN PATENT DOCUMENTS

| | | | |
|---|---|---|---|
| CN | 204500106 | U | 7/2015 |
| WO | 2011086369 | A1 | 7/2011 |

* cited by examiner

MUSEUM SHOWCASE, HAVING DETECTION SENSORS, ADJUSTMENT ACTUATORS, ALARMS AND A PROCESSING UNIT CONNECTED TOGETHER

CROSS-REFERENCE TO RELATED APPLICATIONS

The present application claims priority to Italian Application No. UB2016A000768 filed on Feb. 15, 2016, which is incorporated herein by reference in its entirety.

FIELD

The present invention relates to a museum showcase, i.e. a showcase intended to be placed in a display place such as a museum, an exhibition or the like and intended for the preservation and display of objects of cultural heritage, such as works of art, historical artefacts and the like, in a protected environment. The term showcase will be sometimes used hereinafter for the sake of brevity, by this however always meaning a museum showcase.

Museum showcases must therefore meet requirements of various types, in relation to the preservation and integrity of the exhibits. Moreover, of course, these showcases have to ensure the best visibility and usability of the exhibits.

BACKGROUND

Various systems are known to ensure that the objects placed in these showcases are always in the best possible conditions, both for their usability and especially for their preservation. For example, air-conditioned museum showcases are known in which the climatic conditions (typically temperature and humidity) are controlled and adjusted continuously depending on the features of the objects; museum showcases are also known with alarm systems that are activated in case of burglary attempts, or in the case where the climatic conditions are different from those expected. It is also known to place fixed electronic devices in the vicinity of the museum showcases capable of interacting with portable devices (typically audio-guides) made available to the public, so as to activate user contents in the portable devices, specifically relating to the objects held in the showcase.

The Applicant has realized that the control and protection functions and the information functions of a museum showcase can advantageously be managed in an integrated system.

SUMMARY

Therefore, the present invention relates to a museum showcase according to claim 1; preferred features are set forth in the dependent claims.

More in particular, a museum showcase for display and preservation of objects of cultural heritage according to the invention comprises a display space visible to the public for receiving objects, at least a detection sensor of a parameter of the showcase and at least one of an alarm and an actuator for adjusting a parameter of the showcase and is characterized in that it further comprises a processing unit and a showcase interface, the showcase interface is operatively connected between the sensor, the adjusting actuator and/or the alarm and the processing unit, in order to transmit information from the sensor to the processing unit and to transmit commands from the processing unit to the adjusting actuator and/or the alarm.

The museum showcase is therefore completely controllable by means of the processing unit, which receives information from one or more dedicated sensors that is considered necessary for the specific showcase and which manages actuators and alarms so as to maintain the desired conditions and/or signal abnormal situations, according to the information received. Of course, a showcase according to the invention is particularly interesting when the sensors are numerous and/or when the alarms and the actuators are numerous; however, even with only one sensor and one alarm or actuator, the showcase is of great interest for the intelligent management of the museum space.

Preferably, the museum showcase further comprises a user interface, operatively connected to the processing unit and to an external user, in order to transfer information from the processing unit to the external user and to send commands from the external user to the processing unit. In this way, the showcase is in operating contact with the external user (a guard, a museum operator and/or a museum director) without requiring the physical presence thereof in the same place where the showcase is.

The user interface can be shared between several showcases, in communication with the operating unit of each of them.

Preferably, the processing unit, the showcase interface and the user interface (if any) are incorporated into a single processing assembly.

Preferably, the user interface is connected with the outside of the showcase via a wireless connection, more preferably encrypted. In this way, it is not necessary to arrange wired connections between the showcase and the place where the external user's presence is expected, and it is no longer even necessary to provide a specific location for the external user. It is therefore possible to easily predict the involvement of more external users, responsible for different aspects of surveillance, requiring different skills and/or different direct intervention needs: for example, a burglar alarm must be directed to a guard who is close to the showcase and who can thus intervene promptly, while a decline in performance and/or features of the showcase will be advantageously directed a technician able to understand the meaning thereof and arrange the necessary interventions in a timely and appropriate manner, even from a very remote location.

Said at least one sensor may be of many types.

For example, preferably, the sensor comprises at least one sensor inside the display space of the showcase selected from the following:

sensors of lighting parameters, sensors of climatic parameters, sensors of pollution parameters, sensors of attempts of breaking and entering the showcase, sensors of deterioration and/or damaging of parts of the showcase, sensors for detecting an open/close state of the showcase, other sensors of operative parameters of the showcase and/or of the objects contained therein.

Moreover, preferably, the sensor comprises at least one sensor outside the display space of the showcase selected from the following:

sensors of lighting parameters, sensors of climatic parameters, sensors of pollution parameters, sensors of attempts of breaking and entering the showcase, sensors of deterioration and/or damaging of parts of the showcase, sensors for detecting an open/close state of the showcase, sensors for detecting the presence of people in proximity of the showcase, sensors for detecting the characteristics of people in proximity of the showcase, other sensors of the parameters of the place where the showcase is.

Likewise, said at least one of an alarm and an actuator for adjusting a parameter of the showcase may be of many types.

For example, preferably, said at least one of an alarm and an actuator for adjusting a parameter of the showcase comprises at least an alarm and/or an actuator for adjusting a parameter inside the display space of the showcase, selected from the following:

devices for adjusting lighting parameters, devices for adjusting climatic parameters, devices for adjusting filtering systems, devices for closing the showcase, sound and/or light alarms, other devices for adjusting operative parameters of the showcase and/or of the objects contained therein.

Moreover, preferably, said at least one of an alarm and an actuator for adjusting a parameter of the showcase comprises at least an alarm and/or an actuator for adjusting a parameter outside the display space of the showcase, selected from the following:

devices for adjusting lighting parameters, devices for adjusting climatic parameters, devices for adjusting filtering systems, devices for closing the showcase, devices for managing the public flow to the place where the showcase is, sound and/or light alarms, other devices for adjusting the parameters of the place where the showcase is.

Preferably, the museum showcase comprises a presentation unit connected to the processing unit for presenting multimedia contents based on the conditions detected by the sensor. In this way, you can present specific content according to the conditions detected: for example, an audio or video file related to the objects displayed may be presented when it is detected that a person from the public has approached, and it may be in a specific language depending on the nationality of the person, detected for example through the identification data of a smartphone brought by the person him/herself.

Preferably, the museum showcase comprises a storage unit connected to the processing unit, for recording over time the parameters detected by the detecting sensor and/or the commands transmitted to the adjusting actuator and/or the alarm. The data stored can then be made available in a form processed as desired (in tables, charts, etc.), possibly through the processing unit. This allows complete control of the showcase over time; it is also possible to reduce the need for a permanent human control since when the operator intervenes for a check, he/she can verify not only the current data but also historical ones.

BRIEF DESCRIPTION OF DRAWINGS

Further features and advantages of a museum showcase according to the present invention will appear more clearly from the following description of an embodiment thereof, made with reference to the accompanying drawings. In such drawings.

DESCRIPTION

Figure 1:
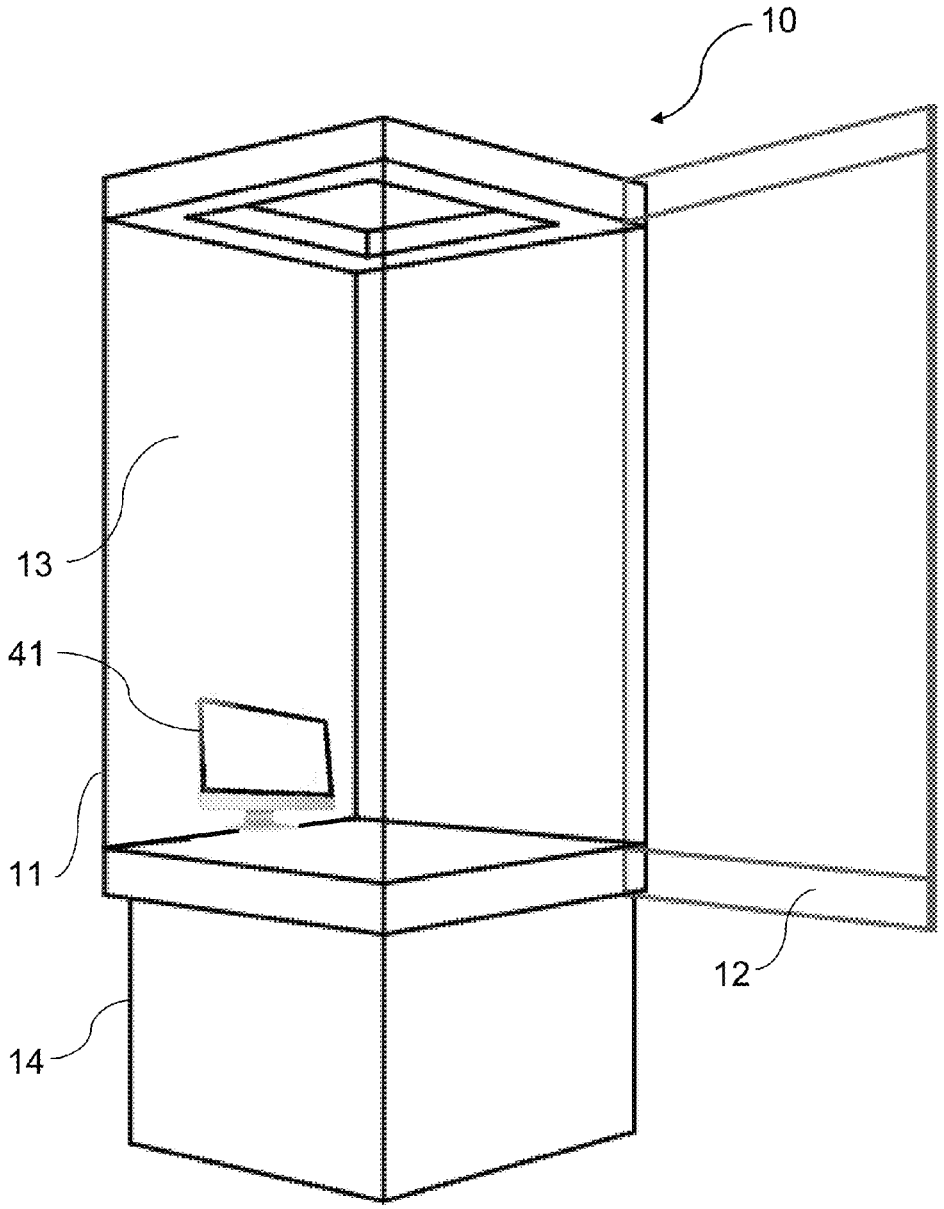
FIG. 1 is a schematic view of a museum showcase according to the invention.
Figure 2:
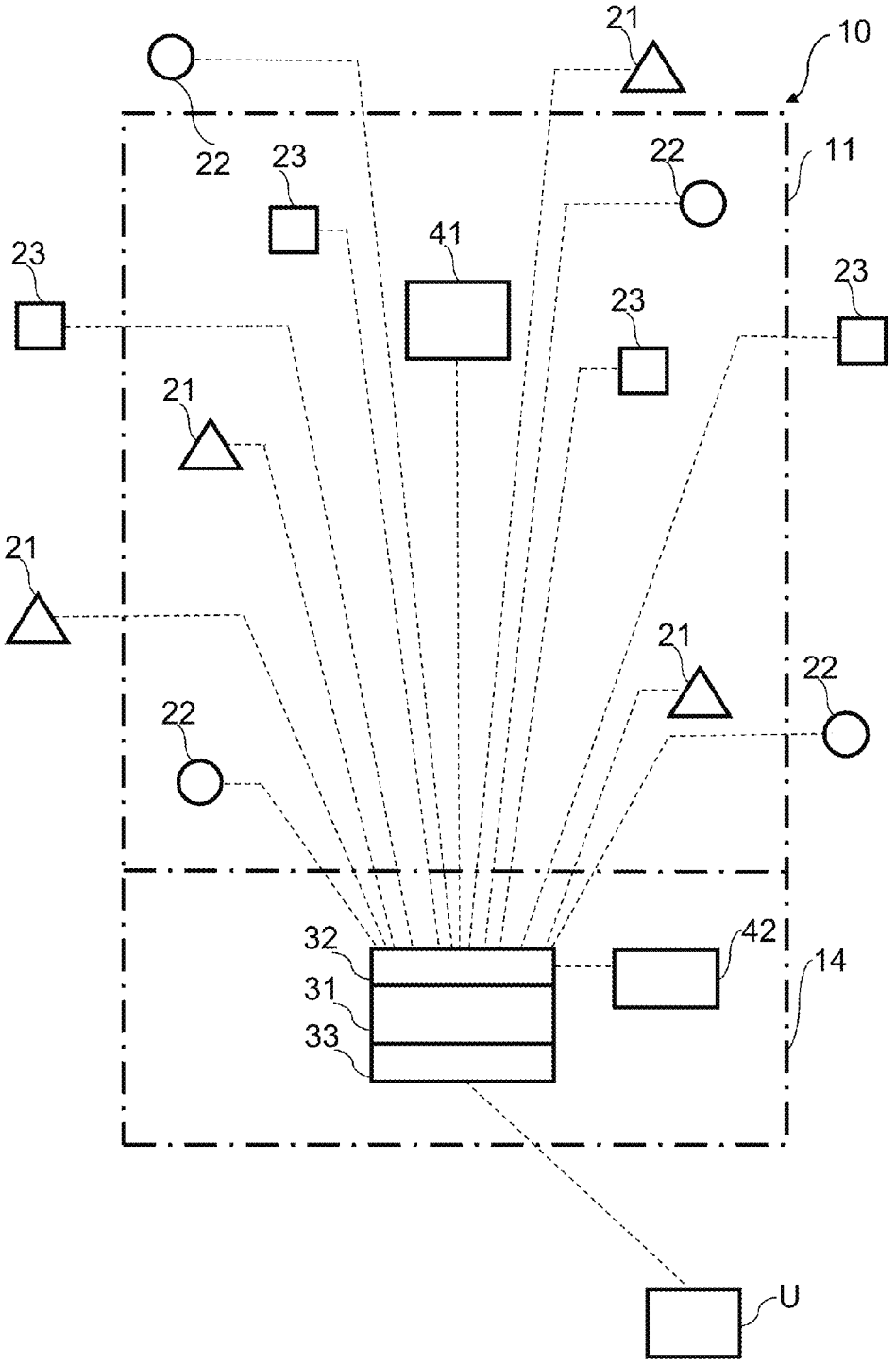
FIG. 2 is a block diagram of the functional components of the showcase in FIG. 1.

In the figures, reference numeral 10 indicates as a whole a museum showcase, which comprises a closed display space 11, accessible via an opening wall 12 and visible from the outside through the same opening wall 12 and fixed walls 13, all made exclusively or predominantly with transparent material, typically glass. The display space 11 can accommodate objects B such as works of art, objects of cultural heritage and the like.

Underneath the display space 11, showcase 10 also comprises a closed technical space 14, not visible from the outside.

Many construction features specific to showcase 10 (such as the closing system, seals, lighting equipment, air conditioning system, etc.) are known per se and may be different depending on the specific application; these features will not be described hereinafter and are not shown (or only shown roughly) in the drawings. Of course, the invention is not limited to any of such construction features.

The museum showcase 10 also comprises one or more sensors 21 for detecting specific parameters of showcase 10 and at least one of alarms 22 and actuators 23 for adjusting specific parameters of the museum showcase 10. Moreover, the museum showcase 10 comprises a processing unit 31 and a showcase interface 32: the showcase interface 32 is operatively connected between sensors 21, the adjusting actuators 23, alarms 22 and the processing unit 31, and thus allows the transmission of information from sensors 21 to the processing unit 31 as well as the transmission of commands from the processing unit 31 to the adjusting actuators 23 and alarms 22.

Moreover, preferably, the museum showcase 10 also comprises a user interface 33, which is operatively connected to the processing unit 31 and to an external user U and thus allows the transfer of information from the processing unit 31 to the external user U and the sending of commands from the external user U to the processing unit 31.

The external user U referred to herein is a person or a machine (computer) able to receive the information sent by the processing unit 31 and possibly to decide what action to take as a result of such information. For example, the external user U may be a guard, able to receive a signal of danger and take prompt action to remove a person in the public who approached too close to the museum showcase 10; or, the external user U may be an external computer, programmed to process—alone or with the aid of a specific expert—information about internal states of the display space 11 received by sensors 21 and act on actuators 23 with specific commands to ensure that the objects accommodated in the museum showcase 10 are kept in the best conditions.

The processing unit 31, the showcase interface 32 and the user interface 33 (if any) are incorporated into a single processing assembly accommodated in the technical space 14. The user interface 33 is connected with the outside, i.e. with the external user U, preferably via a wireless connection, such as a Wi-Fi, Bluetooth, NFC connection, more preferably with protection encoding.

Sensors 21, alarms 22 and actuators 23 may be of many different types, depending on the specific control requirements of showcase 10 and of objects B contained therein.

For example, sensors 21 may be sensors internal to the display space 11 (i.e. which detect internal parameters in such a space, materially placed therein or facing on it), such as:

sensors of lighting parameters, such as sensors of the light intensity of lamps inside showcase 10 or lighting sensors of objects B;

sensors of climatic parameters, such as thermometers, hygrometers, anemometers;

sensors of pollution parameters, such as concentration gauges of dust or dangerous substances for objects B;

sensors of attempts of breaking and entering showcase 10, such as volumetric detectors (able to detect the movement of bodies in the display space) or dynamometric detectors (able to detect the movement of showcase 10 itself);

sensors of deterioration and/or damaging of parts of showcase 10, such as control devices of seals or gluing;

sensors for detecting an open/close state of showcase 10;

other sensors of operative parameters of showcase 10 and/or of objects B contained therein.

Moreover, sensors 21 may be sensors external to the display space 11 (i.e. which detect parameters external to such a space), such as:

sensors of lighting parameters, such sensors of the light intensity of lamps in the rooms where showcase 10 is;

sensors of climatic parameters, such as thermometers, hygrometers, anemometers;

sensors of pollution parameters, such as concentration gauges of dust or dangerous substances for objects B or for the public;

sensors for detecting the presence of people in proximity of showcase 10, such as volumetric detectors, capacitive detectors, detectors of electromagnetic fields (associated with mobile phones carried by the people);

sensors for detecting the characteristics of people in proximity of the showcase, through interaction with mobile phones carried by the people;

other sensors of the parameters of the place where showcase 10 is.

For example, alarms 22 may be audible and/or light alarms, either internal or external to showcase 10, placed on showcase 10, near it or in a remote position.

For example, actuators 23 may be actuators internal to the display space 11 (i.e. which change internal parameters in such a space, materially placed therein or facing on it), such as:

devices for adjusting lighting parameters, such as electrical or electronic switches or regulators;

devices for adjusting climatic parameters, such as air-conditioning systems, heaters, coolers, air flow regulators;

devices for adjusting filtering systems;

devices for closing showcase 10, such as controlled locks or doors;

other devices for adjusting operative parameters of showcase 10 and/or of objects B contained therein.

Moreover, actuators 23 may be actuators external to the display space 11 (i.e. which change parameters external to such a space), such as:

devices for adjusting lighting parameters, such as electrical or electronic switches or regulators;

devices for adjusting climatic parameters, such as air-conditioning systems, heaters, coolers, air flow regulators;

devices for adjusting filtering systems;

devices for managing the public access to the place where showcase 10 is, such as access portals, barriers or turnstiles;

other devices for adjusting operative parameters of the place where showcase 10 is.

Moreover, showcase 10 is preferably provided with a presentation unit 41 connected to the processing unit 31, for example via the showcase interface 32; this presentation unit 41 may for example be an audiovisual display for presenting multimedia contents based on the conditions detected by the detecting sensor 21.

Showcase 10 preferably comprises also a storage unit 42 connected to the processing unit 31, for example via the showcase interface 32, recording over time the parameters detected by the detecting sensor 21 and/or the commands transmitted to the adjusting actuator 23 and/or the alarm 22. The stored data is for example processed (in the form of tables, graphs, etc.) in the processing unit 31 and displayed in the same presentation unit 41 (or in another separate presentation unit), thus allowing complete control of showcase 10 over time.

Showcase 10, thanks to the invention, is able to detect a number of internal and external parameters so as to be able to offer a variety of features that make the use thereof particularly advantageous.

The basic operation is as follows. Be it assumed that the object accommodated in showcase 10 requires a specific ambient temperature, in order to be properly preserved. Showcase 10 will therefore be provided with a specific actuator 23, i.e. a temperature controller; this may be a heater if the outside temperature is typically lower than the temperature required for the object, or a cooler if the outside temperature is instead typically higher than the required temperature, or a complex climate control system if the outside temperature may be higher or lower than that required, for example depending on the different seasons. Moreover, showcase 10 will be provided with a specific sensor 21, i.e. a temperature sensor. The processing unit 31 will then be programmed to receive the temperature data from sensor 21, compare it with the needs of object B and accordingly control actuator 23. In this way, an automatic control of showcase 10 is implemented, with reference to the temperature. In addition, the processing unit 31 may be programmed to send to an external user U (a guard) information on the current situation at any time and a possible alarm signal, should for any reason the temperature required not be maintained.

With the invention, this same type of control may be provided for any other functional parameter of showcase 10 or of object B contained therein. The processing unit 31 will in this case be programmed to receive information from all the necessary sensors 21 and send commands to all the necessary actuators 22; alarms 23 may be provided both on showcase 10 and in remote places, depending on how to organize the control.

The control of the various parameters, managed by a single processing unit 31, may be conducted in a correlated manner for the individual parameters, not only independently as would inevitably happen in a showcase provided with specific more or less automatic control systems of the same parameters. For example, if abnormal heating is detected, not only the air conditioning system may be adjusted but some or all of the functions that may produce a heating inside showcase 10 may be interrupted or minimized.

Moreover, showcase 10 according to the invention may offer features that have never been possible thus far. An example is the case where the external user U is a smart mobile device (typically a smartphone or a specific device provided at the entrance of the museum space) of a person in the public. In this case, possibly as a result of identification and registration, the person in the public will receive information of various types on his/her mobile device U, relating to object B accommodated in showcase 10 or in general to the museum space in which showcase 10 is located, depending on what is detected by the various sensors 21.

Moreover, a brief descriptive content related to object B may be provided (on the presentation unit 41 or on the mobile devices U of the people close to showcase 10) if showcase 10 detects the presence of many people from the public in the vicinity of showcase 10, while a more complete descriptive content may be transmitted when showcase 10 detects the presence of a limited amount of public.

Moreover, if showcase 10 detects an excessive crowding around itself, such for example as to potentially cause difficulties for the air conditioning system, an intervention on the air conditioning system where showcase 10 is may be activated first, thereafter possibly also a limitation of access to the space.

In addition, information about the crowding near each showcase 10 of a museum space may be gathered by a single user U (user-control machine), which depending on such information may provide the public—via the presentation unit or the mobile devices—with suggestions for a better tour of the museum space, such as by providing indications of personalized paths in order to better distribute the public.

Moreover, object B accommodated in showcase 10 may be a dynamic work, i.e. which appears differently over time: a moving work, a work consisting in whole or in part of a movie, a work which emits sounds messages. In such a case, showcase 10 according to the invention may be able to detect the changing of object B itself, consequently informing the public; or, even, showcase 10 may be able to control the activation of operating cycles of object B, depending on the presence of public in the vicinity of showcase 10 itself

The invention claimed is:

1. Museum showcase for display and preservation of objects of cultural heritage, comprising a display space visible to the public for receiving objects, at least one detection sensor of a parameter of the showcase and at least one actuator for adjusting a parameter of the showcase, characterized in that it further comprises:

a processing unit, and a showcase interface, wherein a detection sensor of the at least one detection sensor, and an associated actuator of the at least one actuator, are placed inside the display space of the showcase, and wherein the showcase interface is operatively connected between the sensor, the adjusting actuator and the processing unit, in order to transmit information from the sensor to the processing unit and to transmit commands from the processing unit to the adjusting actuator.

2. Museum showcase according to claim 1, further comprising:

a user interface, operatively connected to the processing unit and to an external user, in order to transfer information from the processing unit to the external user and to send commands from the external user to the processing unit.

3. Museum showcase according to claim 1, wherein the processing unit and the showcase interface are incorporated into a single processing assembly.

4. Museum showcase according to claim 2, wherein the processing unit, the showcase interface and the user interface are incorporated into a single processing assembly.

5. Museum showcase according to claim 2, wherein the user interface is connected with the outside of the showcase though a wireless connection.

6. Museum showcase according to claim 1, wherein the sensor comprises at least a sensor inside the display space of the showcase selected from the following:

sensors of lighting parameters, sensors of climatic parameters, sensors of pollution parameters, sensors of attempts of breaking and entering the showcase, sensors of deterioration and/or damaging of parts of the showcase, sensors for detecting an open/close state of the showcase, other sensors of operative parameters of the showcase and/or of the objects contained therein.

7. Museum showcase according to claim 1, wherein the sensor comprises at least a sensor outside the display space of the showcase, selected from the following:

sensors of lighting parameters, sensors of climatic parameters, sensors of pollution parameters, sensors of attempts of breaking and entering the showcase, sensors of deterioration and/or damaging of parts of the showcase, sensors for detecting an open/close state of the showcase, sensors for detecting the presence of people in proximity of the showcase, sensors for detecting the characteristics of people in proximity of the showcase, other sensors of the parameters of the place where the showcase is.

8. Museum showcase according to claim 1, wherein said at least one actuator for adjusting a parameter of the showcase comprises at least one actuator for adjusting a parameter inside the display space of the showcase, selected from the following:

devices for adjusting lighting parameters, devices for adjusting climatic parameters, devices for adjusting filtering systems, devices for closing the showcase, sound and/or light alarms, other devices for adjusting operative parameters of the showcase and/or of the objects contained therein.

9. Museum showcase according to claim 1, wherein said at least one actuator for adjusting a parameter of the showcase comprises at least one actuator for adjusting a parameter outside the display space of the showcase, selected from the following:

devices for adjusting lighting parameters, devices for adjusting climatic parameters, devices for adjusting filtering systems, devices for closing the showcase, devices for managing the public flow to the place where the showcase is, sound and/or light alarms, other devices for adjusting the parameters of the place where the showcase is.

10. Museum showcase according to claim 1, comprising a presentation unit connected to the processing unit, for presenting multimedia contents based on the parameter detected by the sensor.

11. Museum showcase according to claim 1, comprising a storage unit connected to the processing unit, for recording over time the parameters detected by the detecting sensor and/or the commands transmitted to the adjusting actuator.

12. Museum showcase for display and preservation of objects of cultural heritage, comprising a display space visible to the public for receiving objects, at least one detection sensor of a parameter of the showcase and at least one of an alarm and an actuator for adjusting a parameter of the showcase, characterized in that it further comprises:

a processing unit, a showcase interface, the showcase interface operatively connected between the sensor, the adjusting actuator and/or the alarm and the processing unit, in order to transmit information from the sensor to the processing unit and to transmit commands from the processing unit to the adjusting actuator and/or the alarm, and a presentation unit connected to the processing unit, for presenting multimedia contents based on the parameter detected by the sensor.

13. Museum showcase according to claim 12, wherein the presentation unit is placed inside the display space.

* * * * *